United States Patent [19]

Durbin

[11] Patent Number: 4,565,061

[45] Date of Patent: Jan. 21, 1986

[54] STRING FOR RACKETS

[76] Inventor: Enoch J. Durbin, 246 Western Way, Princeton, N.J. 08540

[21] Appl. No.: 560,400

[22] Filed: Dec. 12, 1983

[51] Int. Cl.[4] ..... D02G 3/40; D02G 3/38; D02G 3/44

[52] U.S. Cl. ..... 57/234; 57/225; 57/244; 57/251

[58] Field of Search ..... 57/210, 211, 232, 234, 57/236, 241, 242, 243, 250, 251, 225, 244

[56] References Cited

U.S. PATENT DOCUMENTS 2,401,291 5/1946 Smith ..... 57/242
4,084,399 4/1978 Kanemaru ..... 57/210 X
4,381,639 5/1983 Kress ..... 57/210 X
4,391,088 7/1983 Salsky et al. ..... 57/232 X

*Primary Examiner*—Donald Watkins

[57] ABSTRACT

A string is provided which has been stabilized to retain its initial tension over a long period when strung in a racket, and which has a high ratio of tensile strength to modulus of Elasticity to cause the deflection of the string woven membrane to be almost linear with applied force. The string has a very low Modulus of elasticity to cause the region of the string in the vicinity of the ball impact point to stretch easily and provide a cup for the ball at the moment of highest string membrane deflection.

10 Claims, No Drawings

STRING FOR RACKETS

BACKGROUND OF THE INVENTION

Characteristics of the Prior Art

It has been the general understanding, heretofore, that to provide good playability in games using a racket to strike a ball such as in tennis, squash, badminton, racket ball, etc. it is desirable to utilize a string network made of strings which have a high tensile strength and a low elasticity or high elastic modulus. The general understanding has been that high deflections of the string membrane structure are undesirable in that they cause the angle of departure of the ball from the strings to vary widely over the face of the strings causing poor directional control (See, Am. J. Physics, Vol. 47, No. 6, page 484, Prof. H. Brody). With the advent of larger span racket faces, this problem became more pronounced. To reduce the problem manufacturers began to recommend use of higher initial string tensions proceeding from 45–55 pounds to 65–80 pounds. To permit these high tensions to be used higher tensile strength strings were required.

It has generally been believed, heretofore, that it was necessary to have a low elasticity or a high elastic modulus in the string to be able to maintain these high tensions over time. (See Tennis, September 1983, pg. 44, Tracy Leonard, Equipment Editor.)

It has also been generally believed that an important aspect of play is to be able to impart a controlled spin to the ball to both change its flight path and bounce to confuse the opponent. It has been believed, heretofore, that to achieve this spin it is desirable to provide an increase in friction between the ball and strings and that this can be enhanced by providing a rougher or more irregular surface to the strings which are used to make the string membrane (See U.S. Pat. No. 4,005,863; Feb. 1, 1977; Henry), (See U.S. Pat. No. 3,926,431; Dec. 16, 1975, Delorean).

Rivers in U.S. Pat. No. 4.055,941 describes a method of string manufacture which minimizes bonding material and which provides a string with a "tangent modulus" of 247,000 psi/in/in to 560,000 psi in the examples shown in his patent, where the tangent modulus is the elastic modulus of the string at the initial tensions or the string stress when the racket is not in play. The breaking stress of this string is approximately 75,000 psi. The "tangent modulus" of gut strings are typically 250K psi/in/in. River's strings are similar to gut in play, and this is deemed to be a desirable characteristic.

THE INVENTION

In a theoretical investigation aimed at determining the characteristics of the string membrane, which are desirable for use in a racket to strike a ball, I have discovered, that control of speed, direction, and spin of the ball is considerably enhanced when the string membrane deflection is made linearly proportional to the propelling force.

This linear relationship should enhance the player's ability to accurately control the depth of his return since the ball velocity becomes proportional to his applied strike force. This linear relationship should cause the time that the ball resides on the strings (dwell time) to be independent of the applied force. The importance of this characteristic in play is greatest in control of the azimuth angle of the ball flight path.

This linear relationship should cause the membrane to cup around the ball increasing the frictional force between the strings and the ball thereby enhancing the possibility of imparting a high degree of spin to the ball.

A racket made in accordance with the present invention and strung with a thermo-plastic polymer, where the deflection of the membrane was linearly proportional to the applied force over the range of forces normally experienced in play, proved that the theoretical predictions of enhanced playing characteristics were true. Azimuth, and depth control and the ability to cause the ball to spin are all considerably advanced over the prior art as was predicted.

I have also shown in theoretical studies that when the membrane deflections are small, as in a ball racket, the force applied to the ball is related to string membrane deflection by an equation of the form $$Fl_o = 0.02\, E_s A_s \delta^3 + T\delta$$

Where $l_o$ is related to the span of the string in the racket frame,

Where $E_s$ is the elastic modulus of the string at the initial string tension (often called tangent modulus), Where $A_s$ is the string cross section area, Where T is the initial string tension, Where $\delta$ is the string membrane deflection on impact.

To increase the range of the forces over which the membrane deflection is linear or proportional to applied force I have found that it is necessary to increase the ratio of the second coefficient to the first coefficient in this equation or $$T/E_s A_s$$

The maximum tension T which can be applied is limited by the tensile strength of the string, therefore one can construct a string performance index (S.P.I.) which is adapted from the above relationship.

$$S.P.I. = \frac{E_L}{E_s}$$

where $E_L$ is the tensile stress limit of the string (break stress).

A high value of S.P.I. provides a string which can provide much better control of the ball in play than does a string with a low S.P.I. I have found theoretically and experimentally that an ideal S.P.I. is achieved when the string used in a racket to strike a ball has an elastic modulus which is less than twice the break stress. The dCesired S.P.I. is greater than 0.5 and preferably between 0.5 and 2.0.

There are also limits on the absolute values of the numerator and denominator of S.P.I. I have found that the maximum tensile stress should be greater than 20,000 psi. This condition is necessary to permit the strings to be drawn up taut enough to reduce the trampoline effect when the ball rebounds from the strings. I have also found that the elastic modulus at the initial tension at which the racket strings are strung should be less than 120,000 psi/in/in.

I have also discovered that when the S.P.I. is greater than 0.5 and the deflection slope is mostly determined by the tension on the strings, rather than on the string elasticity, the string membrane is more stable in holding its initial tension over time in contrast with the conventional understanding described previously.

One can create a high S.P.I. by raising $E_L$ which thereby permits use of a high initial tension in a string. Improvements in control by this method however are achieved at the expense of a reduction in efficiency of the strung racket. The higher tension increases energy loss by stopping the ball more rapidly and thereby increasing the compression of the ball, which increases heat losses in the ball.

The efficiency of the racket string system is in reality a question of personal choice. A player who likes to swing vigorously would prefer a less efficient racket. In either case a high S.P.I. provides a string membrane with deflection proportional to force for the widest range of player preferences.

String Preparation

I have created a string with an S.P.I. greater than 0.5 with a tensile strength greater than 20,000 psi and a modulus of elasticity which is less than 120,000 as follows.

A resilient core of synthetic, thermoplastic polymer of cross sectional area of about $1.0\times10^{-3}$ (inches)$^2$ is encased in a network of about 40 interlaced fine fibers of the same material, each fiber of area of about $2\times10^{-5}$ (inches)$^2$. The fine fibers surround the resilient core at an approximate angle of 32° to the string axis of symmetry. Half of the fine fibers are twisted around the core in one direction and are interwoven with the other half which are twisted in the opposite direction.

A preferred polymer is nylon. The polymer core and fine threads had the following approximate physical properties before being assembled into a string.

$E_L=113{,}000$ psi $E_s=486{,}000$ psi/in/in $E_L/E_s=0.23$.

The total structure is bound together by an aqueous dispersion of a polyurethane adhesive to hold the string components together, as is common practice and well known in the making of multifilament Nylon strings.

After being formed the string is relieved of internal stresses created during manufacture by heating the string to approximately 250° F. for approximately 10 minutes. The final cross sectional area of the string is approximately 0.028 (inches)$^2$. The final string had the following approximate physical characteristics:

$E_L=65{,}000$ psi $E_s=72{,}000$ psi/in/in $E_L/E_s=$S.P.I.$=0.903$.

From the above data is can be seen that in the composite string prepared as I have indicated the major change occurred in the Elastic modulus ($E_s$) which decreased sufficiently to provide the desired high S.P.I. within the range specified.

Although this is a method of construction which I prefer, I have found that considerable variation in the details of the method of preparation of the string can still result in a racket string of S.P.I. which is greater than 0.5. For example, considerably higher S.P.I. than that shown above may be obtained by winding a plurality of fibers (constituting the thread) at larger angles to the string axis of symmetry than 32°, around cores of smaller diameter, and by relieving the internal stresses of higher temperatures than 250° F. Other methods of satisfying the performance criterion I have taught here will be obvious to those skilled in the art of string formation.

Although the principles stated in this specification have never been stated before, it is important to see if others have perhaps inadvertently provided strings with the properties described here.

For this purpose I examined the characteristics of synthetic and natural strings which have been or are being used for racket strings. A major string supplier (Prince) acclaims the fact that its strings have a high tensile strength and very short elongation or high modulus of elasticity. For example "Prince Spin plus Synthetic" string has a tensile strength to modulus of elasticity ratio of 0.30. The tensile stress limit is about 82,000 psi and the elastic modulus at initial tension is 274,000 psi. "Gamma Gut III", a widely used synthetic string, has a ratio of 0.33. The tensile stress limit is about 55,000 psi, and the elastic modulus at initial tension is about 165,000 psi. "Ashaway TriCor 710" boasts of a low elongation and high strength with a ratio of 0.32. The tensile stress limit is about 85,000 psi, and the elastic modulus at initial tension is about 260,000 psi. A popular French string "Technifibre 515" has a ratio of 0.41, with a tensile stress limit of about 73,000 psi and an elastic modulus at initial tension of about 187K. "Wynn Gutex" also a synthetic fibre has a ratio of 0.33 with a tensile stress limit of 61,000 psi and an elastic modulus at initial tension of 186,000 psi.

Prince Synthetic Gut—a string made of nylon fibers intertwined and claimed to provide the feel of gut has a ratio of 0.265 with a tensile strength of 77,500 psi and an elastic modulus at initial tension of about 294,000 psi.

Gut when used in rackets is typified by that offered by VS gut with a ratio of 0.13 with a tensile stress limit of 67,000 psi and an elastic modulus at initial tension of 518,000 psi. Professor H. Brody has measured a 16 gauge gut string and found an elastic modulus at initial tension of 306,000 psi.

We see from these ratios that manufacturers of synthetic string have concluded that they should provide a tensile strength to elastic modulus ratio which is low as in natural gut and not high as I have taught. In an earlier time when only natural materials were employed even lower ratios were provided.

Many non-synthetic materials have been used in the past to string sport rackets. Among these are silk, with a ratio of 0.02; cotton, ratio of 0.06; rubber ratio of about 2.5, with an $E_L$ from 1000 to 4000 psi, which makes it too weak for stringing in game rackets at the tensions normally used; and steel with a ratio of 0.025 with a tensile stress limit of 65,000 and an elastic modulus of $29\times10^6$ psi

I claim:

1. A string wherein said string is characterized by both a break stress which is greater than 20,000 psi and an elastic modulus which is less than twice the break stress, said string comprising a composite made of a plurality of individual fibers, the axis of said individual fibers making a substantial angle to the axis of symmetry of said string, said individual fibers wrapped around a central resilient core, the core and individual fibers being bound together into a string.

2. A string as in claim 1, wherein said resilient core is made of a thermo plastic polymer.

3. A string as in claim 1 wherein said break stress is between the limits of 20,000 psi, and 100,000 psi.

4. A string as in claim 1 wherein said string is characterized by a string performance index (S.P.I.) which is between 0.5 and 2.0, S.P.I. being defined by the ratio S.P.I. $= E_L/E_s$ wherein $E_L$ = Tensile Stress Limit (Break Stress) (psi), $E_s$ = Elastic Modulus at the initial tension (tangent modulus) (psi/in/in).

5. A string as in claim 1, wherein said resilient core is made of rubber.

6. A string as in claim 1, wherein said core and individual fibers are bound together by a reslient adhesive.

7. A string as in claim 6, wherein said resilient adhesive is an aqueous dispersion of a polyurethane adhesive.

8. A string as in claim 6, wherein said string is relieved of internal stresses after manufacture.

9. A string as in claim 1, wherein said substantial angle to the axis of symmetry of said string is greater than 15 degrees.

10. A string as in claim 1, wherein said string is characterized by an elastic modulus which is less than 120,000 psi.

* * * * *